US006500284B1

(12) United States Patent
Zhou et al.

(10) Patent No.: US 6,500,284 B1
(45) Date of Patent: Dec. 31, 2002

(54) PROCESSES FOR CONTINUOUSLY PRODUCING FINE GRAINED METAL COMPOSITIONS AND FOR SEMI-SOLID FORMING OF SHAPED ARTICLES

(75) Inventors: Youdong Zhou, St. Laurent (CA); Jian Lu, Pointe-Claire (CA); Navtej Singh Saluja, Cambridge, MA (US); Alfredo Riviere, V, Caracas (VE)

(73) Assignee: Suraltech, Inc., Quebec (CA)

( * ) Notice: Subject to any disclaimer, the term of this patent is extended or adjusted under 35 U.S.C. 154(b) by 0 days.

This patent is subject to a terminal disclaimer.

(21) Appl. No.: 09/095,434

(22) Filed: Jun. 10, 1998

(51) Int. Cl.[7] ..... C22F 1/04

(52) U.S. Cl. ..... 148/551; 148/437; 148/452; 148/438

(58) Field of Search ..... 148/437, 551, 148/552, 538

(56) References Cited

U.S. PATENT DOCUMENTS

| | | | | | |
|---|---|---|---|---|---|
| 3,902,544 | A | | 9/1975 | Flemings et al. | |
| 3,948,650 | A | | 4/1976 | Flemings et al. | |
| 3,954,455 | A | | 5/1976 | Flemings et al. | |
| 4,106,956 | A | * | 8/1978 | Bercovici | 148/11.5 A |
| 4,229,210 | A | | 10/1980 | Winter et al. | |
| 4,260,419 | A | * | 4/1981 | Robertson | 75/142 |
| 4,282,044 | A | * | 8/1981 | Robertson et al. | 148/2 |
| 4,310,352 | A | | 1/1982 | Manfre et al. | |
| 4,415,374 | A | | 11/1983 | Young et al. | |
| 5,009,844 | A | | 4/1991 | Laxmanan | |
| 5,195,573 | A | * | 3/1993 | Cryderman et al. | 164/476 |
| 5,470,405 | A | * | 11/1995 | Wyatt-Mair et al. | 148/551 |
| 5,533,562 | A | | 7/1996 | Moschini et al. | |
| 5,571,346 | A | | 11/1996 | Bergsma | |
| 5,630,466 | A | | 5/1997 | Garat et al. | |
| 5,655,593 | A | * | 8/1997 | Wyatt-Mair et al. | 164/476 |
| 5,882,449 | A | * | 3/1999 | Waldron et al. | 148/693 |
| 6,106,638 | A | * | 8/2000 | Paradis et al. | 148/325 |

OTHER PUBLICATIONS

"Semi–Solid Thermal Transformations of Al–Si Alloys and the Resulting Mechanical Properties", *Matl. Sci. Engin.* A237:24 (Sep., 1997).

"Microstructural Evolution During Partial Remelting of Al–Si7Mg Alloys", *Matl. Sci. Engin.* A203:1 (1995).

"Semisolid Melting Casting and Forging", ASM 15:327.

* cited by examiner

*Primary Examiner*—Daniel J. Jenkins
(74) *Attorney, Agent, or Firm*—Choate, Hall & Stewart

(57) ABSTRACT

There is provided a continuous casting and rolling process for continuously producing a deformed fine grain solid metal composition suitable for semi-solid forming. The process is characterized by high throughput, continuity, and precise control of the process parameters, such as solidification rate, rolling temperature and speed and total deformation. The solidification rate is preferred to be in a range of 10 to 150° C./s, and the total deformation is controlled to be larger than a Mises effective strain of 2.3 to obtain a deformed fine grain structure with enough distortion energy. A method combining the continuous casting and rolling process of preparing semi-solid raw material with semi-solid forming of shaped articles is also disclosed.

27 Claims, 6 Drawing Sheets

PROCESSES FOR CONTINUOUSLY PRODUCING FINE GRAINED METAL COMPOSITIONS AND FOR SEMI-SOLID FORMING OF SHAPED ARTICLES

FIELDS OF THE INVENTION

The invention herein relates to methods for producing fine grained metal compositions for use in semi-solid metal forming and for semi-solid forming of shaped articles.

BACKGROUND OF THE INVENTION

Semi-solid metal forming, i.e., forming a metallic alloy at a temperature between its equilibrium liquidus and equilibrium solidus temperatures, is a hybrid metalworking process combining the elements of both casting and forging/extrusion. One of the key elements for the successful operation of a semi-solid forming process is the microstructure of metallic alloy being thus formed. Hereinafter, the term "metal" is used to designate a metallic alloy with a major metallic constituent (base metal) along with various amounts of intentional additions (metallic and non-metallic) that modify the property of the base metal, as well as trace impurities that are deemed to not greatly deteriorate the performance of the alloy when used to fabricate articles thereof.

Conventionally solidified metals cannot be utilized in a semi-solid condition, since a structure of dendritic network forms upon solidification in such metals. Cracks and segregates will occur when a conventionally solidified metal is formed in partially liquid/solid state. Previous studies have shown that raw material of a semi-solid forming process must have a structure comprised of globular or spheroidal grains contained in a lower melting alloy matrix. When heated to a semi-solid temperature, the globular solid phase is retained, suspended in the lower melting alloy liquid matrix.

Producing semi-solid raw material requires specialized techniques. Thermal transformation processes are disclosed in U.S. Pat. Nos. 4,106,956, 5,009,844 and 5,571,346 where solidified metal having a fine dendritic microstructure is heated to and maintained at a superheated temperature above the solidus temperature of the metal, while keeping its body in a solid shape. After the dendritic networks are thermally transformed into globular solid particles, the metal is then formed in semi-solid conditions into an article.

Vigorous agitation processes are disclosed in U.S. Pat. Nos. 3,902,544, 3,948,650, 3,954,455, 4,310,352 (mechanical stirring) and 4,229,210 (inductive electromagnetic stirring) where during billet casting, a metal is agitated while it is in the semi-solid state and then cooled to solidify, forming the primary solid phase comprising discrete degenerate dendrites or nodules while preventing the formation of interconnected dendritic networks. Among the various agitation processes, the magnetohydro-dynamic (MHD) casting process has been commercially applied for producing a variety of fine-grain (mean grain effective diameter about 30 $\mu$m) aluminum alloy bars (diameters varying from 38 to 152 mm) which satisfy the requirements of semi-solid forming. However the agitation processes have practical limitations for casting bars with diameters less than about one inch due to very low productivity.

U.S. Pat. No. 4,415,374 discloses a "SIMA" (strain induced, melt activated) process to make raw material for semi-solid forging. In the process, a solid metal composition is prepared by heating a conventionally solidified and homogenized ingot to a temperature in the hot deformation range of the metal, followed by hot extrusion or hot rolling plus additional cold working, resulting in an essentially directional grain structure. By heating the composition to a temperature above the solidus and below the liquidus, its directional grain structure transforms to a partially solid, partially liquid mixture comprising of uniform discrete spheriodal particles contained in a lower melting liquid matrix. The heated alloy is then formed and solidified while in a partially solid, partially liquid condition, the solidified article having a uniform, fine grained microstructure.

In comparison with MHD casting, the SIMA process described in U.S. Pat. No. 4,415,374 provides an effective method for producing small-diameter alloy bars (diameters less than 38 mm or 1.5 in.) employed in semi-solid forging. For large sizes, however, the economics of the process are not competitive with those of MHD casting for most metal alloys. Furthermore, the procedure of the SIMA process is very cumbersome, comprising the five discrete operations: conventional casting, image homogenization, heating, hot working and cold working. The nature of the process limits its application on a practical and economical scale, for not only large size but also small size semi-solid raw materials.

Therefore, it is an object of the present invention to provide a more superior process for producing a fine-grained solid metal composition suitable for semi-solid metal forming.

It is another object of the present invention to provide a more economical process for producing a fine-grained solid metal composition suitable for semi-solid metal forming. It is a further object of the present invention to provide a process and apparatus for preparing, delivering and semi-solid forming the above precursor material.

SUMMARY OF THE INVENTION

In one aspect of the present invention, there is provided a process of continuous casting and rolling followed by liquid quenching for producing a solid metal composition and structure suitable for semi-solid forming. The process includes providing and delivering a molten metal alloy to a mold of a continuous caster, solidifying the molten metal alloy at a specific rate, continuously rolling the solidified metal to a specific total area reduction by passing through 4 to 12 rolling stands, quenching the solidified and rolled metal, and taking up the product either in coil or as short lengths. The solidifying rate is preferred to be in a range of 10 to 150° C./s to provide a fine dendritic microstructure in the solidified metal, with the dendritic grain size in the range of 20 to 150 $\mu$m and the dendritic arm spacing in the range of 2 to 30 $\mu$m. Hereinafter, grain size is measured by mean grain effective diameter. The total area reduction of the continuous rolling is larger than 90% (equivalent to Mises effective strain of 2.3) to provide a fine-grained deformation microstructure in the rolled metal having a grain size less than 20 $\mu$m and a subgrain size less than 2 $\mu$m. The quenching retains the deformed fine grain structure in the cast and rolled material. Liquid quenching is preferred to obtain the fine grain structure.

The continuously cast and rolled metal composition is heated to a temperature between the solidus and liquidus temperatures to obtain a microstructure which comprises discrete spheroidal particles suspended in a lower melting liquid matrix. The term "semi-solid" refers to a microstructure of spheroidal particles suspended in a lower melting liquid matrix, where solid loading is between 10 to 90%. The semi-solid precursor material is then "formed" by one of the many metal forming processes. This forming process utilizing the precursor material is characterized by high tool life and lower requirements for forming pressure. The articles thus formed have near-net shape and possess superior mechanical properties. The article formed by using the precursor material is characterized by a fine grained microstructure, with discreet spheroidal shaped particles suspended in a lower-melting matrix. The present invention can utilize any size of the precursor material, and the preferred range is bar stock of diameters less than 50 mm.

The throughput of the continuous casting and rolling process is higher than an other known process for making semi-solid precursor material. A typical continuous casting and hot rolling line can produce precursor material at a rate of 6 to 8 tonnes per hour. With modern computerized control systems this productivity can be further enhanced. It has been found that with typical single-wheel casting systems, increasing the cross-sectional area of the cost bar increases the casting throughput; however, as this cross-sectional area increases, segregation of the alloying elements becomes more pronounced.

The another aspect of the present invention provides a method which combines the continuous casting and rolling process for preparing semi-solid precursor material with a process of semi-solid forming of this precursor material into shaped articles. The apparatus employed in this method includes a caster for continuous casting, rolling stands, means for sawing or shearing the rolled metal into slugs of required length, means for heating the slugs to a temperature between the solidus and liquidus temperatures of the metal, means for delivering the rolled and heated slugs to the forming machine, and means for semi-solid die casting or semi-solid forging the slugs into shaped articles.

At first, in the combined process, a molten metal alloy is fed into a mold of the continuous caster and solidified at a solidification rate of preferably 10 to 150° C./s to provide a fine dendritic microstructure in the solidified metal, with the dendritic grain size in the range of 20 to 150 $\mu$m and the dendritic arm spacing in the range of 2 to 30 $\mu$m. The solidified metal then undergoes a specific total area reduction by passing through 4 to 12 rolling stands. The total area reduction of the continuous rolling is larger than 90% (equivalent to Mises effective strain of 2.3) to provide a fine-grained deformation microstructure in the rolled metal having a grain size less than 20 $\mu$m and a subgrain size less than 2 $\mu$m. The rolled metal is then on-line sawed or sheared into slugs of required length. Optionally, the rolled metal can be quenched before or after sawing. The slugs are then delivered to the heating means to be heated at a rate of 0.5 to 20° C./s to a temperature between the solidus and liquidus temperatures of the metal, and holding the heated at the temperature for 1 to 30 minutes. The heated slugs are then delivered to the forming machine. Semi-solid die casting or semi-solid forging can be used to shape the heated "semi-solid" slugs at injection speeds of 0.5 to 15 m/s. The slugs are typically shaped by utilizing a hydraulically powered ram to force into a die or mold (as in die-casting) or by closed die drop-forming (as in forging). Optionally, the semi-solid forging can be multi-stage process where the slug is preformed. The preformed slug can then be either solid forged or semi-solid forged into the article.

BRIEF DESCRIPTION OF THE DRAWING

The invention is described with reference to the following drawings, in which.

DETAILED DESCRIPTION OF THE INVENTION

Figure 1:
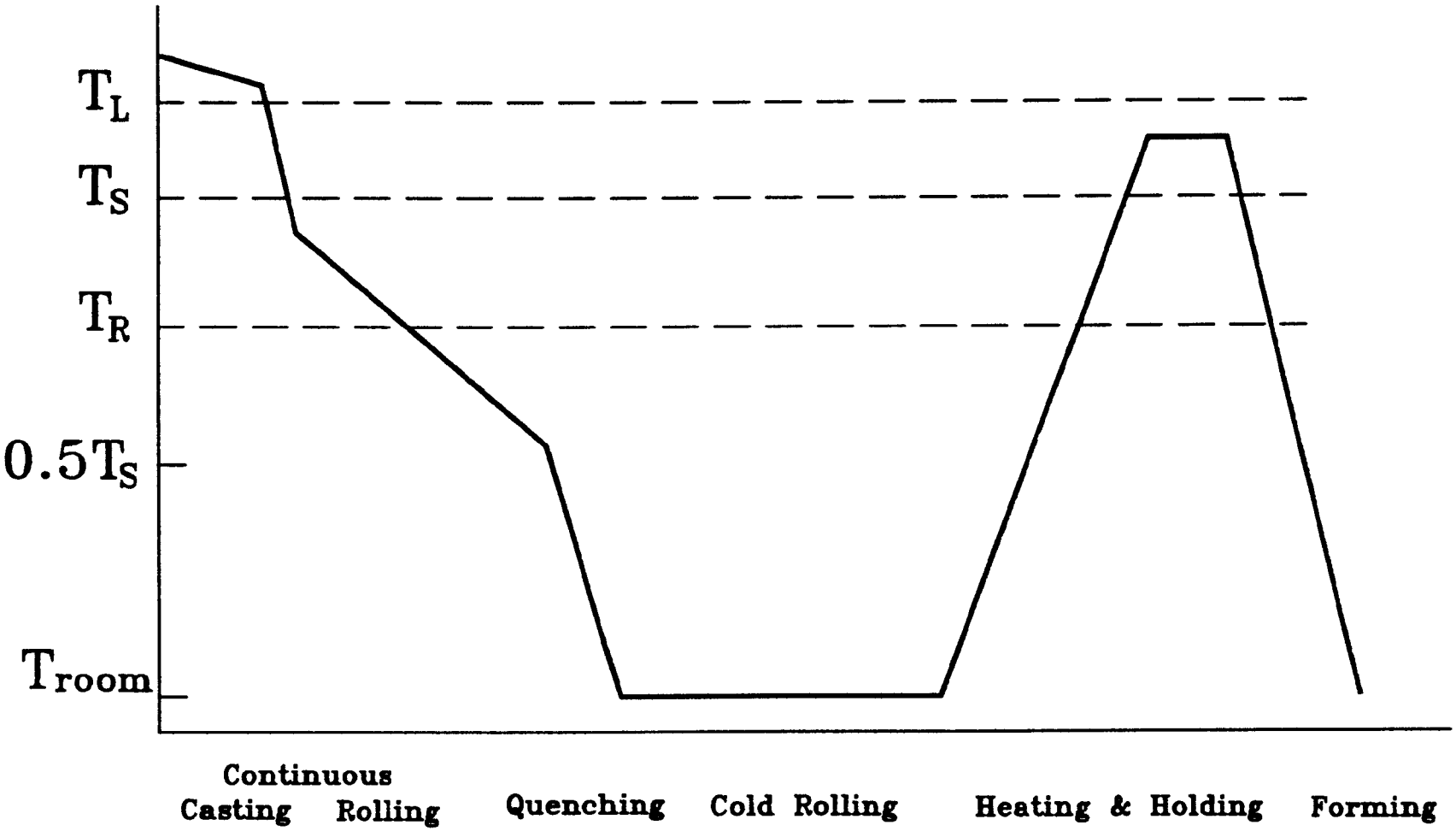
FIG. 1 is a schematic time-temperature profile in accordance with the process of continuous casting and rolling of the present invention.
Figure 2:
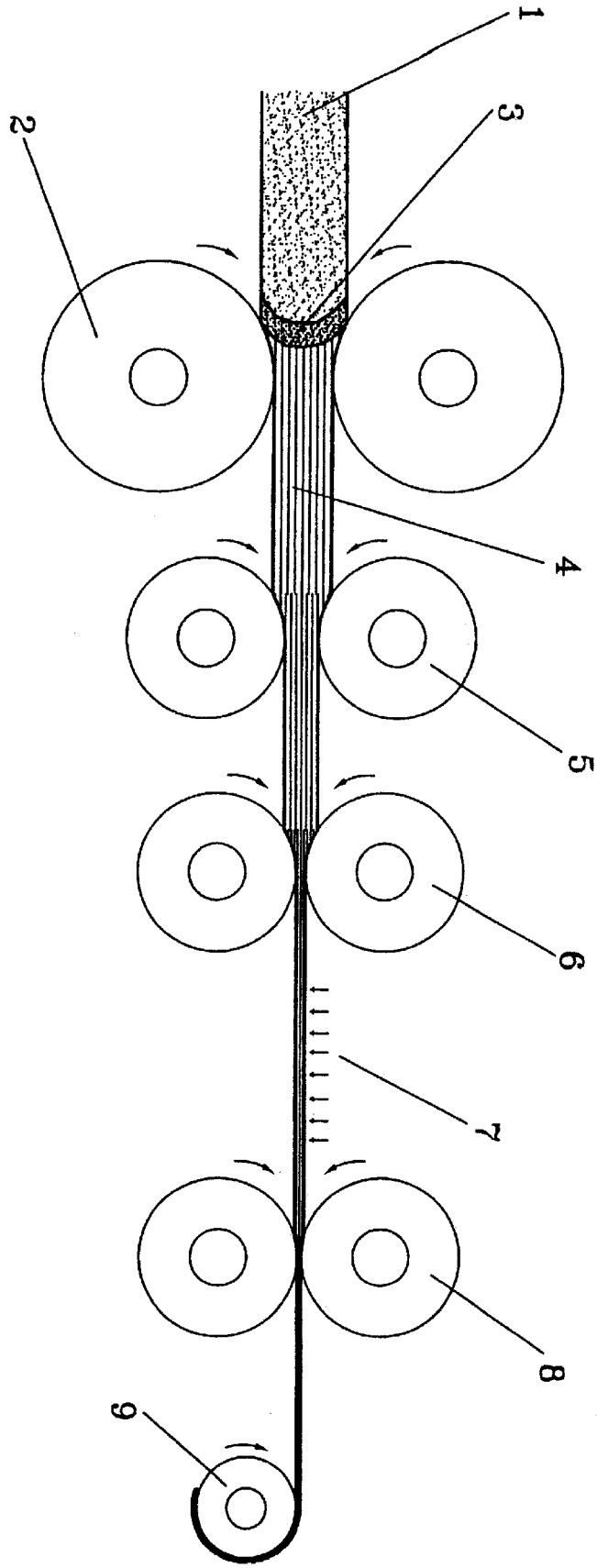
FIG. 2 is a schematic cross-sectional side view of a production line in accordance with the process of continuous casting and rolling of the present invention.

I. Continuous Casting and Rolling Process for Producing a Solid Metal Composition Suitable for Semi-Solid Forming The aspect of the present invention provides a high productivity and low cost process for producing a solid metal composition suitable for semi-solid forming. Continuous roll casting followed by immediately rolling and then quenching is employed herein. A schematic time-temperature profile in accordance with the process is shown in FIG. 1. The vertical axis is temperature; the horizontal axis is time. FIG. 2 illustrates a schematic cross-sectional side view of a production line with respect to the present invention. The method of the invention is suitable for use with any metal or metal alloy. In particular, it may be used with aluminum, magnesium, copper and steel and alloys thereof. Details of the process are described with reference to aluminum alloys, but it is understood that particular processing parameters, such as time and temperature, may be readily modified for use with other metals.

It can be seen from FIGS. 1 and 2 that in the process a molten metal 1 is first delivered to a mold 3 of a roll caster 2, and then solidified in the entrance-side part of the mold 3 at a controlled solidifying rate, followed immediately by hot rolling the solidified metal in the exit-side part of the mold 3. The solidifying rate depends on the nature of the metal. For aluminum alloys, the solidifying rate is preferred to be in a range of 10 to 150° C./s. Such solidifying rate can provide a fine dendritic microstructure in the solidified metal 7, having size of the dendritic grain in the range of 20 to 150 $\mu$m and the dendritic arm spacing in the range of 2 to 30 $\mu$m for aluminum alloys. Such fine dendritic microstructure can provide high quality cast metal and assure that no cracks would be formed in the metal by subsequent rolling. Moreover, fine dendritic microstructures can reduce rolling loads.

Following the quick solidification and primary hot rolling, continuously, the metal is rolled to a specific total area reduction by passing 4 to 12 rolling stands between and including the first and last rolling stand 5 and 6, in order to obtain a deformed fine grain metal composition and structure suitable for use in processes of semi-solid metal forming. Finally the rolled metal is quenched, preferably by a liquid 7, to retain the fine grain microstructure. The produced solid composition can then be taken up with either coil 9 or short lengths. Because the formation of the precursor is carried out in a continuous process, it is far more attractive than prior art methods. For example, the continuous process eliminates separate individual time-consuming processing steps. The process of the invention may be conducted in a single step from $T_{liquidus}$ through $T_{solidus}$ and down to ambient temperature, which avoids frequent cooling to ambient and subsequent reheating to processing temperatures. Lastly, the rolling and deformation steps through the hot and warm stages of formation introduce significantly more stored energy into the resultant bars than prior art processes, which is desirable for semi-solid formation (see below).

Continuous casting and rolling may be carried out using conventional methods, such as but not limited to that described in U.S. Pat. No. 3,991,814, which is herein incorporated by reference.

A deformed fine grain microstructure is desired for the deformed metal to be used in semi-solid forming, since the structure can be transformed into a microstructure which comprises spheroidal particles uniformly distributed in a lower melting liquid when the metal is reheated to a temperature between the solidus and liquidus temperatures of the metal. This is because there is distortion energy stored in the deformed fine grain microstructure. Deformation energy stored in the deformed metal promotes the microstructure transformation by increasing the diffusion rate of the low melting element to grain and subgrain boundaries, resulting in quick melting near grain or subgrain boundaries when the deformed metal is quickly heated to a semi-solid temperature. As an additional advantage, the stored distortion energy induces recrystallization when reheating the deformed and quenched metal to above the recrystallization temperature of the metal. The more the stored distortion energy, the more the recrystallized nuclei can be obtained, leading to finer spheroidal particles when the deformed metal is quickly heated to a semi-solid temperature.

Therefore, the total area reduction of the continuous rolling must be large enough to provide a fine-grained deformation microstructure with enough distortion energy stored in the rolled metal. A total area reduction larger than 90% (equivalent to Mises effective strain of 2.3) is preferred by the present invention, resulting in a deformed fine grain microstructure with grain size less than 20 $\mu$m and subgrain size less than 2 $\mu$m.

During the rolling after solidification, temperature of the deformed metal decreases from the solidus temperature of the metal. Before the last 1 to 4 rolling stands, the rolling temperature is preferred by the present invention to remain in the temperature range of hot working between the solidus temperature and the recrystallization temperature of the metal. For the last 1 to 4 rolling stands, however, the present invention prefers the rolling temperature to be in the range between warm working temperature (about 0.5 $T_{solidus}$ Kelvin) and the recyrstallization temperature (0.7 $T_{solidus}$ Kelvin) of the metal to obtain more distortion energy stored in the rolled metal, as long as no cracks occur in the rolled metal. To generate even more distortion energy, any cold working may optionally be proceeded after quenching. From the present invention, cold rolling is preferred, which can be done by add cold rolling stand 8 into the production line of continuous casting and rolling for preparing a solid metal composition suitable for semi-solid forming.

In preferred embodiments, the production of a solid metal composition suitable for semi-solid forming is a continuous process and cold rolling is conducted in-line. The continuous process may be carried to according to the method described in co-pending application PCT/IB97/01654, which is hereby incorporated in its entirety by reference.

By reheating the deformed fine grain metal composition to a temperature between the solidus and liquidus temperatures of the metal, a microstructure may be obtained which consists of discrete spheroidal particles of 30 to 150 $\mu$m suspended in a lower melting liquid matrix. Spheroidal particles suspended in a lower melting liquid matrix is turned to be a semi-solid structure which contains 10 to 90 vol % solid phase.

The semi-solid precursor material can then be formed by one of the many metal forming processes, e.g., high pressure die casting or forging, characterized by high tool life, near-net shape and lower requirement of forming pressure. After semi-solid forming and solidifying the metal composition, therefore, fine grained microstructure with average grain size of 50 to 150 $\mu$m comprising discrete spheroidal grains uniformly distributed in a lower melting matrix so obtained in the metal, resulting in an article with superior mechanical properties.

Reheating rate is a factor in obtaining the fine spheroidal grain microstructure. The reheating rate should allow for recrystallized nuclei to be formed but not provide enough time for the nuclei to grow up before temperature of the metal reaches its solidus temperature, in order to assure a desired fine spheroidal grain microstructure in the semi-solid formed metal. For aluminum alloys, a reheating rate in the range of 0.5 to 20° C./s is preferred by the present invention. When the metal is reheated to a semi-solid temperature, maintaining at the temperature is necessary to allow enough time for the microstructure to be transformed into discrete spheroidal particles suspended in a lower melting liquid. The maintaining time can be between a few seconds and some hours, depending on the nature of the metal and the required solid-liquid fraction. For a semi-solid aluminum having a solid fraction of 10 to 45%, the maintaining time of 10 to 30 minutes is preferred by the present invention, while for 45 to 90% solid fraction the maintaining time of 1 to 10 minutes is preferred.

The present invention encompasses any size of the metal compositions produced by the process of continuous casting and rolling. A dimension less than 50 mm or 2 in. is preferred by the present invention. Having the nature of continuity and high production speed, normally 100 to 300 m/min., the productivity of preparing a deformed fine grain metal composition suitable for semi-solid forming by the continuous casting and rolling process from the present invention is much higher than by any other known process. Furthermore, the continuous casting and rolling process of the present invention for preparing semi-solid raw material can be completed in one operation, instead of 5 operations in the SIMA process as described by Young.

II. Process for Semi-Solid Forming of Shaped Articles

The aspect of the present invention provides a method which combines the precursor casting and rolling process of preparing semi-solid raw material with a process of semi-solid forming of shaped articles. The apparatus employed in this method includes the continuous casting and rolling production line (FIG. 2), means for on-line sawing or shearing the rolled metal to slugs with a required length, means for heating the slugs to a temperature between the solidus and liquidus temperatures of the metal, means for delivering the rolled and heated slugs, and means for semi-solid forming the slugs to shaped articles. The advantages of a continuous process for the semi-solid formation of shaped articles include increased processing time, increased productivity and reduced operating costs due to fewer operations and fewer heating and cooling steps.

Figure 4:
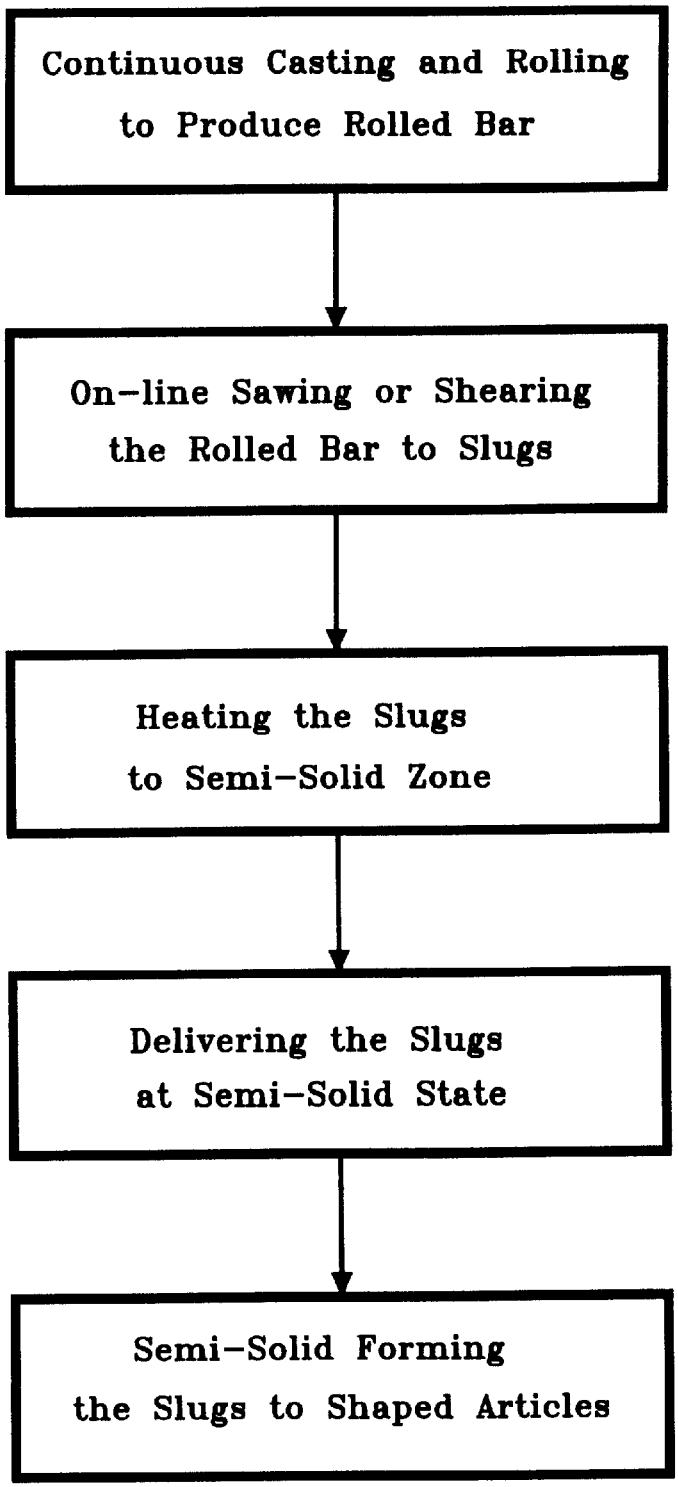
FIG. 4 is a flow chart showing the various steps in the process for semi-solid forming of shaped articles in the present invention.

FIG. 4 shows a flow chart of the steps in the process corresponding to the present invention. As can be seen from FIGS. 1, 2 and 4, a molten metal 1 is solidified in a mold 3 of a roll caster 2 at a controlled solidifying rate. The solidifying rate depends on the nature of the metal, preferred to be in a range of 10 to 150° C./s for aluminum alloys to provide a fine dendritic microstructure having size of the dendritic grain in the range of 20 to 150 μm and the dendritic arm spacing in the range of 2 to 30 μm. Such fine dendritic microstructure can provide high quality cast metal and assure that no cracks would be formed in the metal by subsequent rolling.

The solidified metal is then rolled by passing 4 to 12 rolling stands between and including the first and last rolling stand 5 and 6. The total area reduction of the continuous rolling must be controlled to be large enough for providing a fine-grained deformation microstructure with enough distortion energy stored in the rolled metal.

A total area reduction larger than 90% (equivalent to Mises effective strain of 2.3) is preferred by the present invention, resulting in a deformed fine grain microstructure with grain size less than 20 μm and subgrain size less than 2 μm. Such deformed fine grain structure is suitable for use in the subsequent operation of semi-solid forming of shaped articles.

The control of rolling temperature is also a factor in obtaining the deformed fine grain structure. Before the last 1 to 4 rolling stands, the rolling temperature is preferred by the present invention to remain in the temperature range of hot working between the solidus temperature and the recrystallization temperature of the metal. For the last 1 to 4 rolling stands, however, it is preferred that the rolling temperature is controlled in the range between warm working temperature (about 0.5 $T_{solidus}$ Kelvin) and the recystallization temperature (0.7 $T_{solidus}$ Kelvin) of the metal to obtain more distortion energy stored in the rolled metal, as long as no cracks occur in the rolled metal. To generate even more distortion energy, cold rolling may optionally be proceeded after quenching by adding cold rolling stand 89 into the production line of continuous casting and rolling for preparing a solid metal composition suitable for semi-solid forming.

Continuously, the rolled metal with the rolling temperature is then on-line sawed or sheared to slugs of required length. Optionally quenching can be proceeded before or after sawing/shearing. The precursor slugs are then delivered to the heating means and heated at a specific heating rate to a temperature between the solidus and liquidus temperatures of the metal and retaining at the temperature for a specific time. It can be obtained a microstructure which consists of discrete spheroidal particles suspended in a lower melting liquid matrix. Controlling the rat of heating is desirable to obtain a fine spheroidal particle microstructure. The heating rate should allow for recrystallized nuclei to be formed but not provide enough time for the nuclei to grow up before temperature of the metal reaches its solidus temperature, on order to assure a desired fine spheroidal grain microstructure in the semi-solid formed metal. For aluminum alloys, a reheating rate in the range of 0.5 to 20° C./s is preferred by the present invention.

When the metal is heated to a semi-solid temperature by the heating means, maintaining at the temperature is necessary to allow enough time for the microstructure to be transformed into discrete spheroidal particles suspended in a lower melting liquid. The maintaining time depends on the nature of the metal and the required solid-liquid fraction. For a semi-solid aluminum having a solid fraction of 10 to 45%, the maintaining time of 10 to 30 minutes is preferred by the present invention, while for 45 to 90% solid fraction, the maintaining time of 1 to 10 minutes is preferred.

The heating means can be any type of furnace, as long as it can heat the precursor slugs unfirmly at the required heating rate. For this reason, inductive heating is preferred by the present invention due to its nature of uniform heating and precisely controllable high heat-up rate. If the time for maintaining at a semi-solid temperature is long, e.g. more than 10 minutes for aluminum alloys, a forced-convection-heated furnace claimed from U.S. Pat. No. 5,533,562 is also preferred by the present invention.

After the heating, the deformed fine grain microstructure is transformed to comprise discrete spheroidal particles of 30 to 150 μm uniformly distributed in a lower melting liquid matrix. The heated slugs are then delivered to the means of semi-solid forming. Any apparatus know in the art to be suitable for semi-solid forming may be used in the practice of the invention, such as but not limited to, high pressure injecting apparatus (e.g. high pressure die casting) or forging apparatus.

Because of the spheroidal particle microstructure in the semi-solid slugs, the process of semi-solid forming is characterized by high tool life, near-net shape and lower requirement for forming pressure. After semi-solid forming and solidifying the metal composition, therefore, fine grained microstructure with average grain size of 50 to 150 μm comprising discrete spheroidal grains uniformly distributed in a lower melting matrix is obtained in the metal composition, resulting in a product with superior mechanical properties.

The invention may be understood with reference to the Examples which are included for the purpose of illustration only and which are in no way to be considered limiting of the scope of the invention.

EXAMPLE 1

Figure 3A:
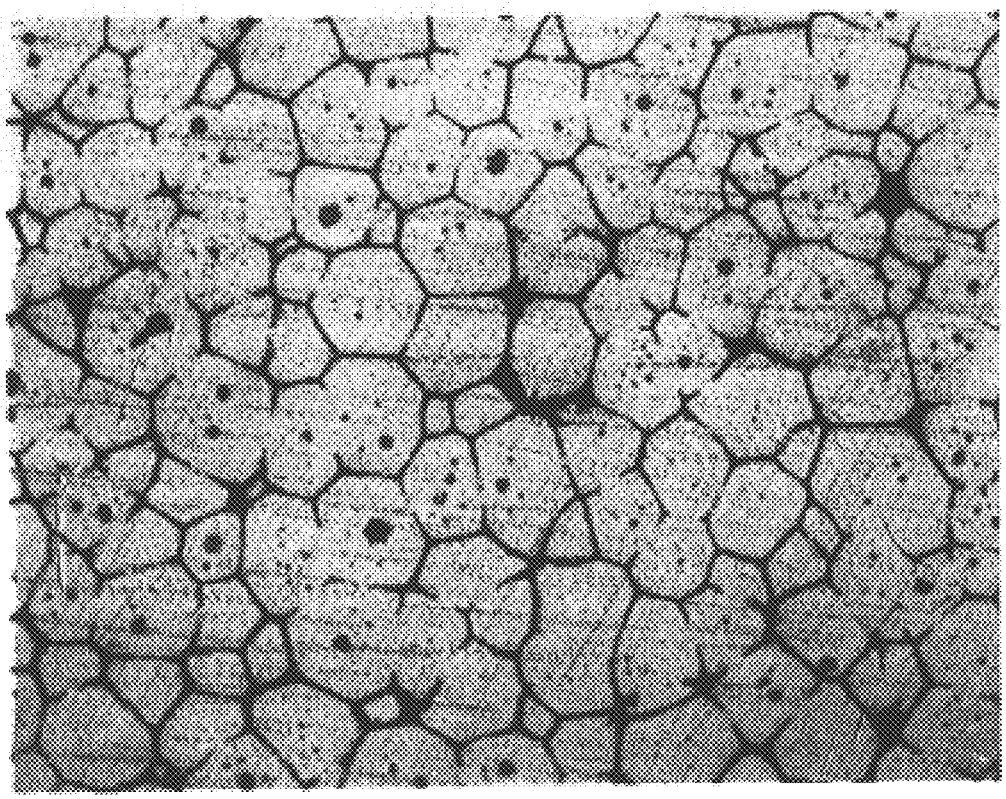
FIG. 3 shows micrographs showing the microstructures of the continuously cast and rolled rods after heated to semi-solid temperatures (magnification 100×): (A) aluminum alloy AA 5154; (B) aluminum alloy AA5052 and (C) aluminum alloy AA6061.

An aluminum alloy, AA5154, containing 3.54 wt % magnesium, 0.37 wt % manganese, 0.26 wt % iron, 0.2 wt % silicon and the balance aluminum and incidental impurities was continuously cast and hot rolled to a rod in a single-wheel caster and eight rolling stands. The solidifying rate was 70–100° C./s and the total area reduction by hot and warm rolling was 97.75%. The rod had a deformed fine grain microstructure, with grain size less than 20 μm. Samples of Φ10×15 mm were cut from the rod and heated inside an infrared reflection furnace from room temperature (20° C.) to 620° C. The heating rate was 5° C./s. The samples remained at 620° C. for 5, 10, 15 and 30 minutes, followed by water quenching to room temperature. Micrographs of the heated and quenched samples show that the microstructures of all the samples, except for the one heated for only 5 minutes, were transformed into a microstructure having spheroidal grains contained in a lower melting matrix (now frozen). FIG. 3A is a photomicrograph corresponding to the sample which was heated for 10 minutes at 620° C. The globules have an average diameter of 70 μm.

EXAMPLE 2

Figure 3B:
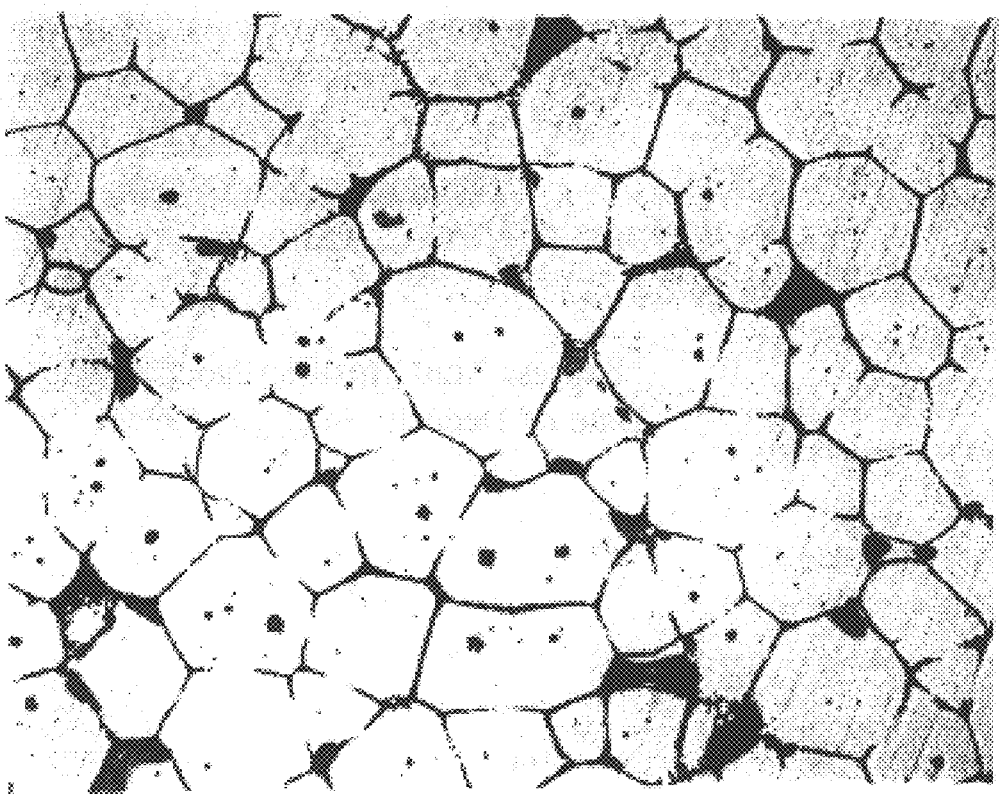

An aluminum alloy, AA5052, containing 2.69 wt % magnesium, 0.22 wt % chromium, 0.2 wt % iron, 0.16 wt % silicon and the balance aluminum and incidental impurities was continuously cast and hot and warm rolled to a rod as described in Examples 1. Samples of Φ10×15 mm were cut from the rod ad heated inside an infrared reflection furnace from room temperature (20° C.) to 630° C. The heating rate was 5° C./s. The samples remained at 620° C. for 15 minutes, followed by water quenching to room temperature. FIG. 3B is a photomicrograph of the corresponding microstructure.

EXAMPLE 3

Figure 3C:
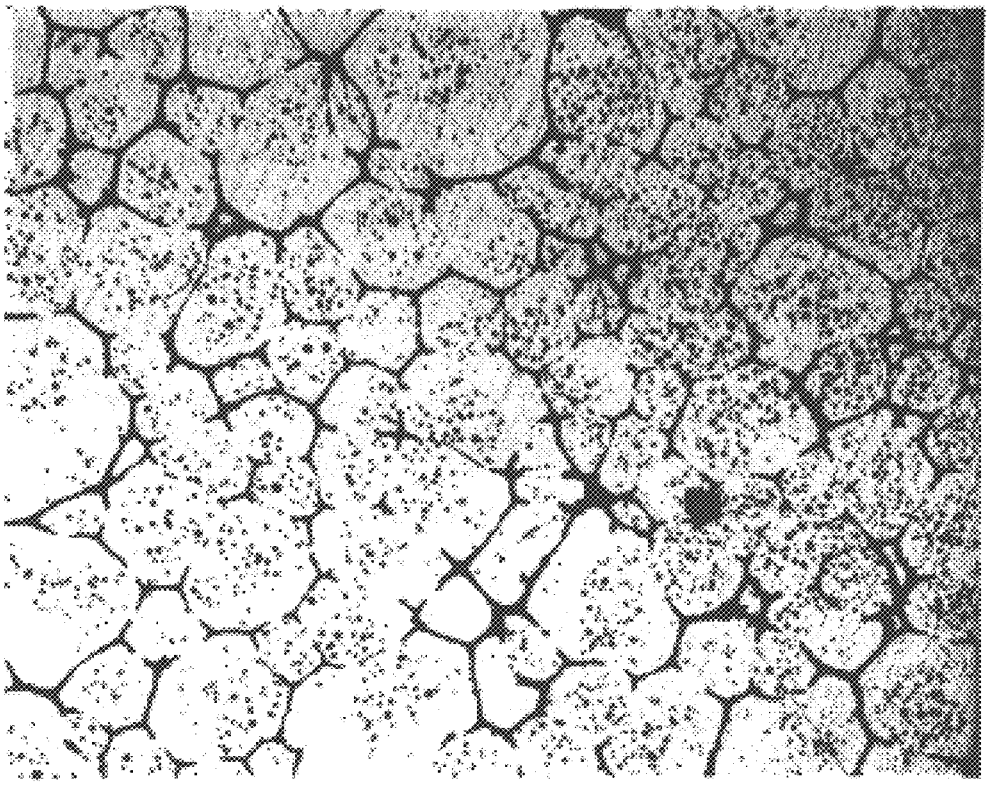

An aluminum alloy, AA6061, containing 0.89 wt % magnesium, 0.19 wt % copper, 0.51 wt % iron, 0.75 wt % silicon and the balance aluminum and incidental impurities was continuously cast and hot and warm rolled as described in Examples 1 and 2. Samples of Φ10×15 mm were cut from the rod and heated inside an infrared reflection furnace from room temperature (ca. 20° C.) to 620° C. The samples remained at 620° C. for 15 minutes, followed by water quenching to room temperature. FIG. 3C depicts the corresponding microstructure.

Other embodiments of the invention will be apparent to those skilled in the art from a consideration of the specification or practice of the invention disclosed herein. It is intended that the specification and examples be considered a exemplary only, with the true scope and spirit of the invention being indicated by the following claims.

We claim:

1. An integral process for semi-solid forming of shaped articles, comprising:

solidifying a molten metal in a mold of a continuous caster at a controlled solidifying rate;

in-line rolling the solidified metal to a specific amount of deformation by passing through a number of rolling stands;

on-line sawing or shearing the rolled metal to slugs;

heating the slugs to a temperature between the solidus and liquidus temperatures of the metal and holding at the temperature for a specific time; and semi-solid forming the rolled and heated slugs to shaped articles.

2. The process of claim 1, wherein the metal is solidified at a solidifying rate selected to provide a fine dendritic microstructure in the solidified metal.

3. The process of claim 1, wherein the solidifying rate is in a range of 10 to 150° C./s for aluminum alloys.

4. The process of claim 1, wherein the solidifying rate can provide a fine dendritic microstructure having size of the dendritic grain in the range of 20 to 150 μm and the dendritic arm spacing in the range of 2 to 30 μm for aluminum alloys.

5. The process of claim 1, wherein the rolling deformation provides a deformed fine grain structure containing enough distortion energy such that upon heating the quenched metal at a temperature above $T_{solidus}$ and below $T_{liquidus}$ the metal is transformed into spherical particles suspended in a lower melting point liquid.

6. The process of claim 1, wherein the rolled metal has a grain size of less than 20 μm and a subgrain size less than 2 μm.

7. The process of claim 1, wherein the rolling deformation 5 is larger than 90% area reduction (equivalent to Mises effective strain of 2.3).

8. The process of claim 1 wherein the casting and rolling deformation is carried out using a plurality of rolling stands.

9. The process of claim 8 wherein the rolling deformation is carried out using 4 to 12 rolling stands.

10. The process of claim 8 wherein the rolling stands closest to the mold provide hot rolling for the rolled metal, with rolling temperature in the range between the solidus temperature $T_{solidus}$ and the recrystallization temperature (0.7 $T_{solidus}$ Kelvin) of the metal.

11. The process of claim 8 wherein rolling stands which follow the hot rolling of the rolling deformation provide warm rolling for the rolled metal, with rolling temperature in the range from 0.5 to 0.7 $T_{solidus}$ Kelvin to obtain more distortion energy stored in the rolled metal.

12. The process of claim 11 wherein the rolling temperature of the warm rolling deformation is further selected to prevent cracks from occurring in the rolled metal.

13. The process of claim 1 further comprising cold working the solidified metal prior to reheating to provide more distortion energy stored in the deformed fine grain structure.

14. The process of claim 13 wherein the cold working comprises cold rolling.

15. The process of claim 5 wherein the deformed fine grain structure may be transformed to a microstructure which consists of discrete spheroidal particles of 30 to 150 μm suspended in a lower melting liquid matrix when reheating the deformed metal composition to a temperature between the solidus and liquidus temperatures of the metal and maintaining the temperature for a specific time.

16. The process of claim 15, wherein the deformed fine grain structure is suitable for use in processes of semi-solid metal forming.

17. The process of claim 1 further comprising heating the quenched metal to a temperature between the solidus and liquidus temperatures of the metal and maintaining the temperature for a specific time, whereby a microstructure which consists of discrete spheroidal particles of 30 to 150 μm suspended in a lower melting liquid matrix is formed.

18. The process of claim 17 wherein the heating occurs at a rate to permit recrystallization of nuclei to occur, but which not provide enough time for the nuclei to grow up before the solidus temperature is reached.

19. The process of claim 18 wherein the heating rate is in the range of 0.5 to 20° C./s for aluminum alloys.

20. The process of claim 18 wherein the maintaining time allows enough time for the deformed microstructure to be transformed into discrete spheroidal particles suspended in a lower melting liquid.

21. The process of claim 18 wherein the metal comprises aluminum alloys having a volume fraction solid of 10 to 45% and the maintaining time is in the range of 10 to 30 minutes.

22. The process of claim 18 wherein the metal comprises aluminum alloys having a volume fraction solid of 45 to 90% and the maintaining time is in the range of 1 to 10 minutes.

23. The apparatus employed in the integral process for semi-solid forming of shaped articles, comprising:

a continuous casting and rolling production line, including a continuous caster and about 4 to 12 rolling stands;

means for on-line sawing or shearing the rolled metal of claim 22 to slugs with a required length;

means for heating the rolled slugs to a temperature between the solidus and liquidus temperatures of the metal;

means for delivering the rolled and heated slugs; and means for semi-solid forming the rolled and heated slugs to shaped articles.

24. The apparatus of claim 23 wherein the heating means comprises inductive heating.

25. The apparatus of claim 23 wherein the heating means comprises electric forced-convection-heated resistant furnace.

26. The apparatus of claim 23 wherein the means of semi-solid forming comprises forging.

27. The apparatus of claim 23 wherein the means of semi-solid forming comprises high pressure die casting.

* * * * *